United States Patent [19]

Boyd et al.

[11] 4,064,772

[45] Dec. 27, 1977

[54] TUBING WRENCH WITH AIR POWERED RETURN

[75] Inventors: H. Edward Boyd, Euclid, Ohio; Thomas M. Freiburger, San Rafael, Calif.

[73] Assignee: Cooper Industries, Inc., Houston, Tex.

[21] Appl. No.: 703,065

[22] Filed: July 6, 1976

[51] Int. Cl.[2] ..... B25B 17/00

[52] U.S. Cl. ..... 81/57.13; 81/57.29

[58] Field of Search ..... 81/57.11, 57.12, 57.13, 81/57.14; 415/152 R; 137/625.26, 625.67, 625.69

[56] References Cited

U.S. PATENT DOCUMENTS

| | | | |
|---|---|---|---|
| 2,546,579 | 3/1951 | Adams et al. | 415/152 |
| 3,084,674 | 4/1963 | Watson | 415/152 |
| 3,093,360 | 6/1963 | Krouse | 415/152 |
| 3,257,877 | 6/1966 | Ulrich et al. | 81/57.13 |
| 3,987,692 | 10/1976 | Lesner et al. | 81/57.13 |

*Primary Examiner*—James L. Jones, Jr.

*Attorney, Agent, or Firm*—Owen, Purdue, Emch & Barker

[57] ABSTRACT

The disclosure relates to a pneumatic tubing wrench wherein a radially slotted socket member is rotatably mounted in a housing end portion having a similar slot. When the slots of the socket and the housing are aligned, the socket may be placed over a length of tubing and engaged on a fastener. For realignment of the slots following tightening of a fastener and axial disengagement of the socket from the fastener, a spool type valve is provided near the throttle valve. When the throttle lever is depressed only slightly, the throttle valve is opened to admit a very small flow of air through the secondary exhaust flow path of the tool's air motor, thereby driving the motor in reverse. A spring-biased pin and inclined slot arrangement on a portion of the tool's gearing permits the motor to be driven backward only to the position wherein the socket and housing slots are aligned. When the throttle lever is fully depressed, the spool valve is shifted so that air at line pressure is admitted into the intake area of the motor to drive the motor in the forward direction.

7 Claims, 9 Drawing Figures

TUBING WRENCH WITH AIR POWERED RETURN

BACKGROUND OF THE INVENTION

The invention relates to pneumatic tools, and more particularly to an open ended, power driven tubing wrench wherein a rotatable drive socket must be properly aligned within its housing in order to permit access to and removal of the tool from a length of tubing. Generally, such a tool applies a desired torque to a fastener by slowing to a stall when the desired torque level is reached. The output torque of the tool is regulated through line pressure.

Earlier tubing wrenches employing a rotatable, slotted socket member had to be realigned by hand with the corresponding slot in the housing. Often a release lever was provided to disengage a portion of the drive train leading to the socket member, thereby permitting its free rotation by hand to the aligned position. Subsequently various means were suggested for providing automatic return of the socket member following the tightening of a fastener. See, for example, U.S. Pat. No. 3,535,960, assigned to the same assignee as the present application. The device of this patent utilized a spring which stored rotation energy as the tool was first actuated, then released the energy after removal of the socket member from the fastener to return the socket member to its aligned position. A yieldable detent means was provided to sense the aligned position.

U.S. Pat. No. 3,620,105 discloses an air powered return mechanism for a tubing wrench. The air supply line of the tool includes a bleed orifice which constantly admits a small volume of air to the air motor to drive it slowly in the forward direction. A mechanical detent means connected to the trigger is operable to stop the tool drive mechanism in the desired position when the trigger is released and the motor is operating only on bleed air. When the trigger is depressed, the detent means is cammed into a disengaged position. The patented tool provides an effective return, but besides requiring a mechanical trigger extension lever which is somewhat cumbersome and not adaptable to tubing wrenches which are not of the gun type, the apparatus of this patent also requires a constant bleed of air through the motor, even when the tool is not being used.

SUMMARY OF THE INVENTION

The present invention is a tubing wrench having an air powered return which is simple in construction and which does not require a constant bleed of pressurized air to the tool's motor. The tool utilizes a spool valve adjacent to the throttle valve and operable by the same throttle valve lever. When the lever is fully depressed, both the throttle valve and the spool valve are shifted to open the throttle valve and admit air at line pressure through the spool valve to the motor. When the tubing fastener has been fully tightened and the air motor has reached a stall condition, the throttle valve lever is released and the socket member may be removed from the fastener by axial movement without any residual rotational urging of the socket member on the fastener. The lack of residual urging ofter aids in the removal of the socket from the fastener in cases where burrs or other surface imperfections may be present on the fastener. When the socket member is free of the fastener but still positioned around the length of tubing, the throttle valve lever may be partially depressed, thereby opening somewhat the throttle valve but not shifting the spool valve from its underpressed operational position. The operation can feel this partially depressed lever condition since the spool valve is provided with a stiffer return spring than is the throttle valve. In this position, low volume air is admitted to the secondary exhaust outlet of the air motor to drive the motor slowly in the reverse position. Air is not admitted to the normal inlet of the air motor. The socket member of the tool is permitted to rotate and all drive the motor in reverse less than one revolution, since a device associated with a portion of the drive gearing of the tool stops the reverse rotation of the gearing at the desired starting position. The device, however, allows free rotation of the drive gearing in the forward direction.

DESCRIPTION OF THE PREFERRED EMBODIMENTS

Figure 1:
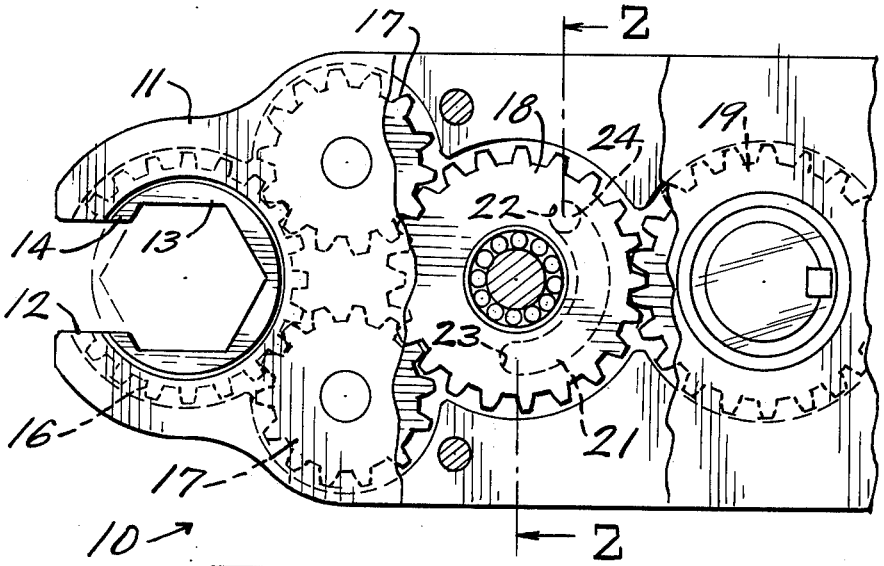
FIG. 1 is a partially broken away view showing a portion of the drive train of a tubing wrench according to the invention.

In the drawings, FIG. 1 shows the forward end 10 of a tubing wrench according to the invention. The wrench includes a housing 11 having a slot shaped opening 12 adapted to be inserted over a length of tubing, for example. Mounted in the housing 11 adjacent to the slot 12 is a rotary drive socket 13 having a similar slotted opening 14 which must be aligned with the housing slot 12 for the tool to be inserted over or removed from a length of tubing. The socket member 13 includes peripheral gear teeth 16 which are enmeshed with a pair of idler gears 17. Intermediate drive gears 18 and 19 lead from the idler gears 17 ultimately, through further gearing (not shown) to the pneumatic motor of the tool. The housing 11, drive socket 13 and gearing thus far described are conventional and are shown, for example, in U.S. Pat. No. 3,535,960.

Figure 2:
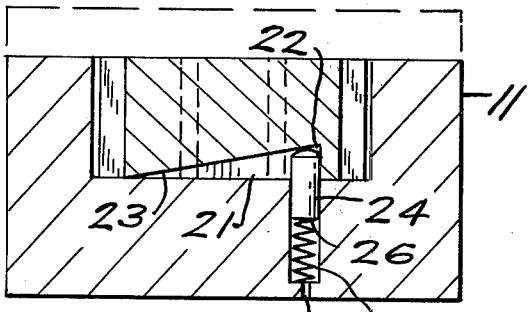
FIG. 2 is a sectional view taken along the line 2—2 of FIG. 1; indicating a plunger and groove mechanism which aids in returning the tubing wrench to its starting position.

The rotatable gear 18 acts as a timing gear for finding the starting position of the drive socket 13, shown in FIG. 1, when the motor and gearing are driven in the reverse direction. The gear 18 includes a helically shaped groove 21 having a deep end 22 and a shallow end 23 which tapers to meet the face (opposite the face seen in FIG. 1) of the rotatable gear 18. As indicated in FIG. 1, the groove 21 is arcuately shaped and concentric with the gear 18 in which it is formed. FIG. 2 shows the groove 21 in section as viewed along the line 2—2 of FIG. 1. A plunger pin 24 slidably positioned in a bore 26 in the housing 11 is lightly biased outwardly toward the helical groove 21 by a light compression spring 27. This plunger pin 24 engages the deep, abutment-shaped end 22 of the helical groove 21 when the gear 18 is rotated backward to the position shown in FIG. 1. This positively stops rearward rotation of the gear 18, the drive socket 13 and the air motor itself, leaving the drive socket 13 in the starting position shown in FIG. 1 with the slots 14 and 12 aligned. On the other hand, when the drive socket and gear 18 are rotated in the forward direction, the spring plunger 24 reciprocates in the housing bore 26 in a camming engagement with the helical groove 21, and rotation of the gear 18 and other rotary components is allowed to proceed freely. The compression spring 27 preferably exerts a minimal force on the plunger pin 24 toward the helical groove 21, so that substantially no wear on the contacting surfaces occurs in normal operation of the tool. In fact, the tolerances between the components may be chosen so that at operating speed, the plunger pin 24 recedes into its bore 26 due to an air pressure buildup in the helical groove 21 in each revolution of the gear 18. To this end, a vent opening 28 may be provided in the housing 11 behind the plunger pin 24. Thus, substantially all contact between the plunger pin and the helical groove can be avoided when the tool is at operating speed.

Figure 3:
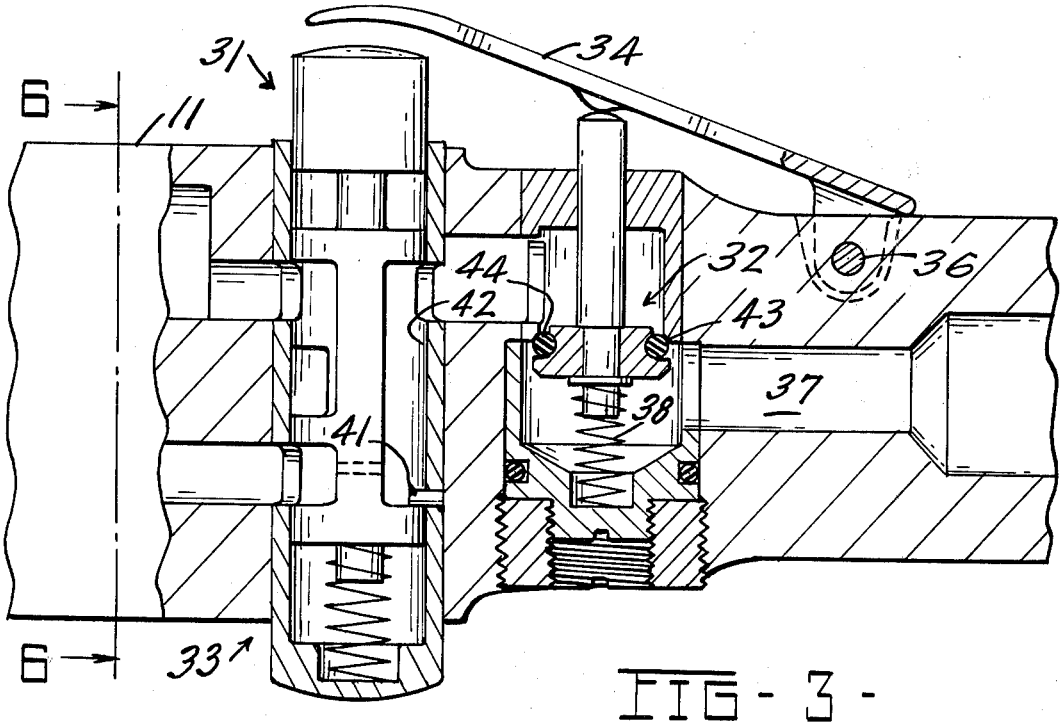
FIG. 3 is a sectional view showing an air-reversing spool valve and a throttle valve associated with the tool, shown in the off position.

FIG. 3 shows an air-reversing spool valve 31 and a throttle valve 32 positioned in a rearward portion 33 of the tool. A throttle lever 34 pivotally mounted to the housing at 36 is positioned to depress both the throttle valve 32 and the spool valve 31 for operation of the tool. However, the lever 34 is so positioned that the throttle valve 32 is partially opened before the lever begins to depress and shift the position of the spool valve 31. Compressed air enters the tool to a position behind the throttle valve 32 by way of an inlet duct 37. In the position shown in FIG. 3, the throttle lever 34 is undepressed and the throttle valve 32 and spool valve 31 are biased into their maximum upward position by compression springs 38 and 39, respectively. The upper position of the spool valve 39 may be defined by a stop 41 in the cylinder 42 within which the spool slides, while the upper position of the throttle valve 32 is of course the off position shown, with an O-ring 43 pressed against a throttle valve seat 44.

Figure 4:
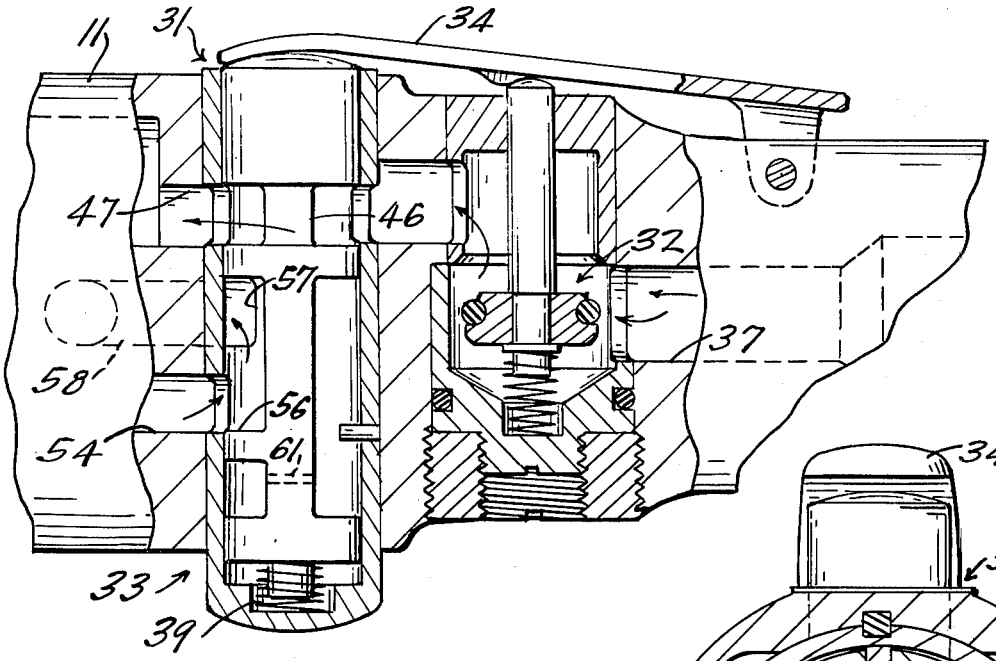
FIG. 4 is a sectional view similar to FIG. 3 showing the air control portion of the tool in the operating position during the tightening of a fastener, with the spool and throttle valves fully depressed.

FIG. 4 shows the throttle lever 34 in its fully depressed position corresponding to normal operation of the tool when a fastener is being tightened. As indicated, the throttle valve 32 is fully opened and the spool valve 31 is in its full downward position. Air at line pressure passes from the duct 37 through the throttle valve 32 and past an open portion of the spool valve 31 wherein a narrow stem 46 does not block the passage of air. The air passes into a duct 47 which leads to an air intake of the pneumatic motor. The other end of the duct 47 can be seen in FIG. 6, leading to the air intake opening, identified by the reference numeral 48. The intake 48 leads into a conventional vane type pneumatic motor 49. As usual, the motor 49 includes primary and secondary exhaust outlets 51 and 52. The primary exhaust outlet 51 is vented through a duct 53 directly to the atmosphere, while the secondary exhaust outlet 52 communicates with a duct 54, the other end of which appears in FIG. 4. In the position of the spool valve 31 shown in FIG. 4, the secondary exhaust travelling through the duct 54 is directed through a channel 56 in the spool valve to an outlet opening 57 communicating through a passage 58 (dashed lines) with the atmosphere.

Once the tool has tightened a fastener to the stall point of the tool, whereby the desired torque is applied, the throttle lever 34 is released by the operator so that the spool valve 31 and throttle valve 32 return again to their upward positions shown in FIG. 3. The drive 13 of the tool (see FIG. 1) may then be axially removed from the hexagonal fastener. However, the tool cannot yet be removed from the length of tubing associated with the fastener because in substantially every instance the rotatable drive socket 13 will not be aligned with the slotted opening 12 in the housing as shown in FIG. 1.

Figure 5:
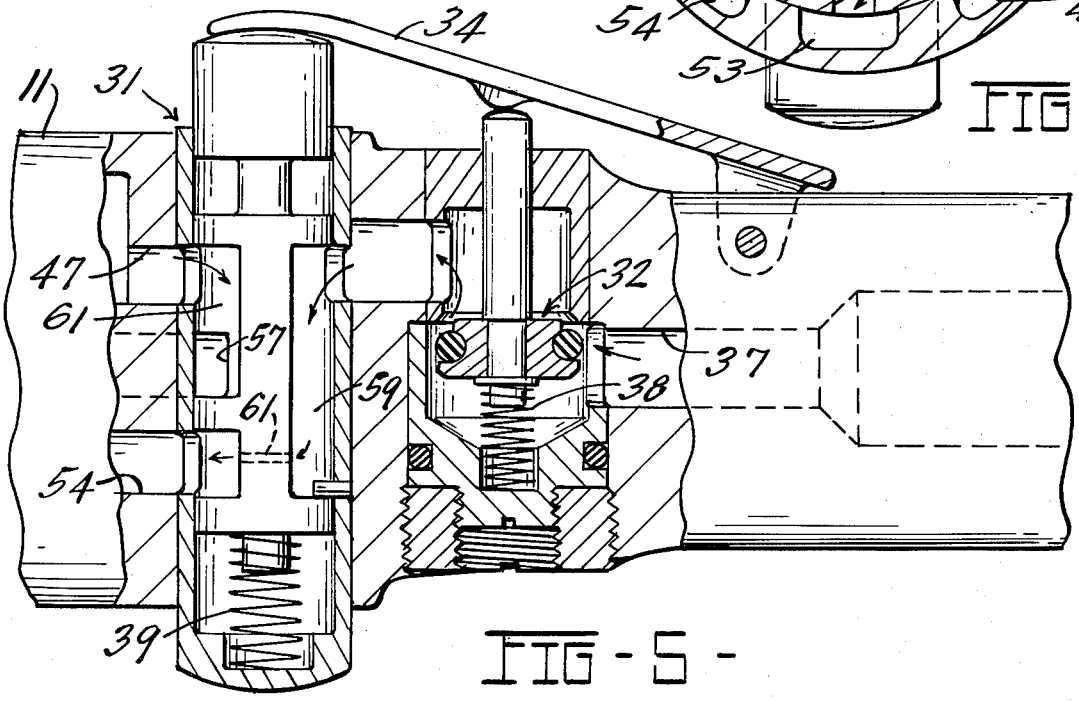
FIG. 5 is another view similar to FIG. 3 showing the air control portion of the tool with the spool valve in its air-reversing position and the throttle valve partially opened.

The air motor 49, the gearing of the tool and the drive socket 13 must therefore be rotated in reverse for a portion of one revolution of the drive socket in order to engage the plunger pin 24 against the end of the helical groove 21 in the rotatable gear 18, as described above in reference to FIGS. 1 and 2. To this end, the throttle lever 34 is only partially depressed as shown in FIG. 5. This partial depression opens the throttle valve 32 to a small extent as indicated, against the bias of the compression spring 38. Once the throttle lever 34 has been depressed this far and contact is made with the spool valve 31, the operator does not depress the lever 34 further but holds it in this position momentarily. The operator can feel this position of the lever 34 because the compression spring 39 associated with the valve spool 31 offers a higher resistance against deflection than does the spring 38. This higher resistance may be provided by the use of a heavier spring 39 than 38, or by a higher preloading upon the spring 39.

Figure 6:
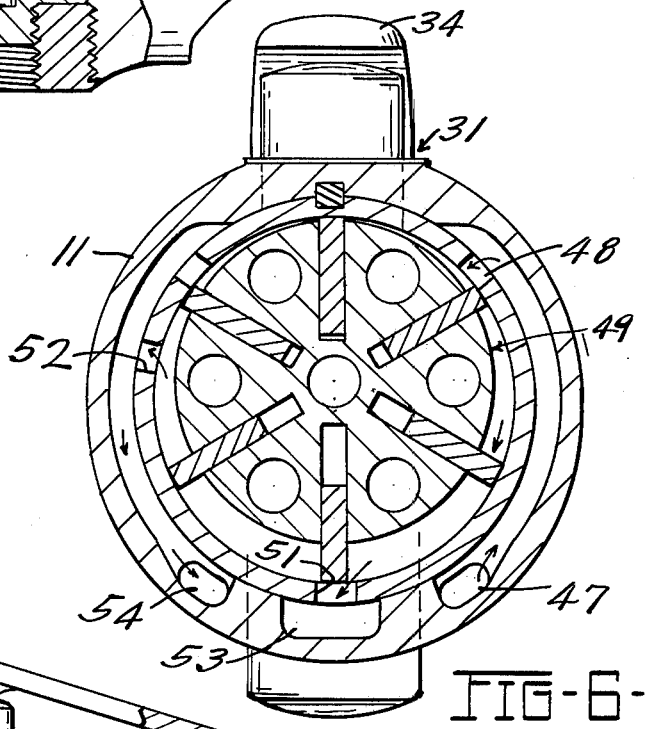
FIG. 6 is a sectional view taken along the line 6–6 of FIG. 3, showing the air motor of the tool and indicating the positions of the air intake and of the primary and secondary exhaust.

With the valve in the position shown in FIG. 5, pressurized air from the duct 37 passes through the throttle valve 32 and is directed not into the duct 47 which leads to the air intake 48 of the air motor, but rather through a channel 39 defined by the spool valve 31, through a small orifice 61 in the spool valve, and into the secondary exhaust duct 54 which leads to the secondary exhaust port 52 of the air motor 49 shown in FIG. 6. The restricted orifice 61 is provided so that the air entering the secondary exhaust port 52 is at low pressure and a low flow rate. This air entering the exhaust port 52 drives the motor 49 in the reverse direction at a very low torque. The motor exhausts through the primary exhaust duct 53 and also backward through the air intake 48 to the intake duct 47. From the duct 47 (see FIG. 5), this portion of the exhaust is directed by a channel 61 to the exhaust outlet 57.

When the drive socket 13 has rotated backward a partial revolution and reached the starting position shown in FIG. 1, the plunger pin 24 engages the deep, abutment shaped end 22 of the helical groove 21 in the rotary gear 18, thus stopping the reverse rotation of the tool's driving elements. The motor easily stalls under this restraint, since reversing air has been admitted to the motor only in limited quantity. The operator then releases the throttle lever 34 to return it to the position shown in FIG. 3 with both the spool valve 31 and the throttle valve 32 in their full upward positions. The socket 13 is now aligned with the slotted opening 12 and the housing of the tool and may be slipped off the length of tubing over which it has been positioned.

Figure 7:
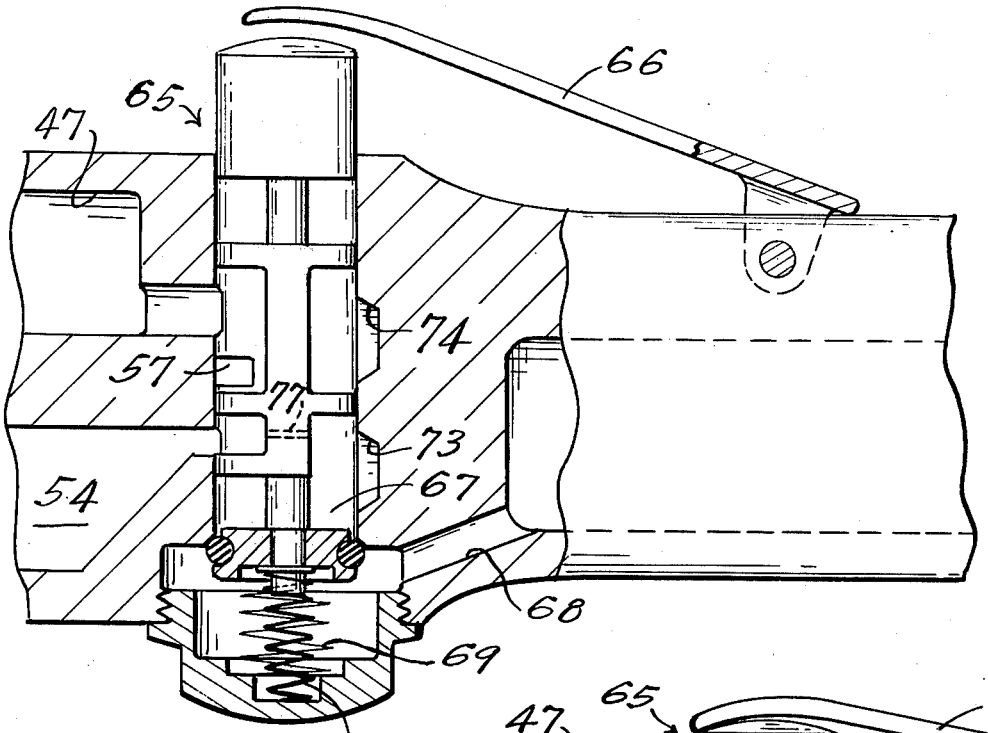
FIG. 7 is a sectional view showing a modified form of the air control portion of the tool, showing a combined spool and throttle valve in the off position.
Figure 8:
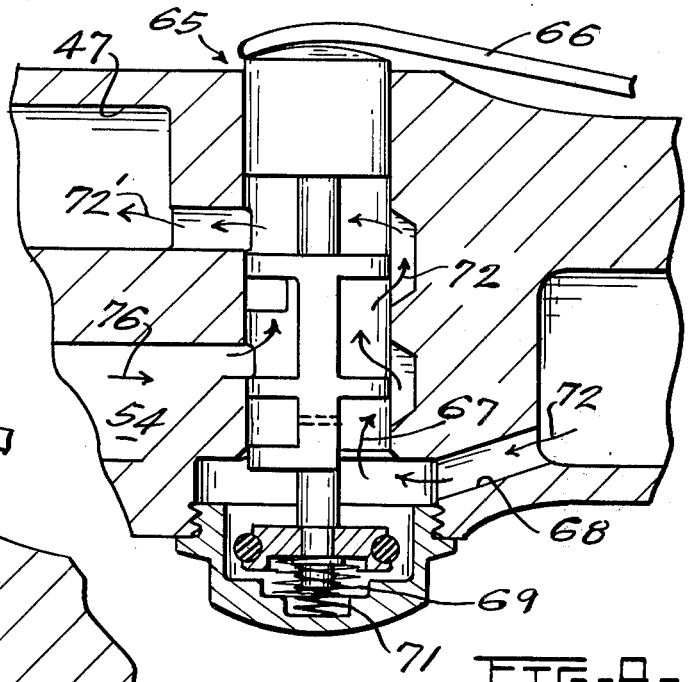
FIG. 8 is a view similar to FIG. 7 but showing the valve in the operating position for tightening of a fastener.
Figure 9:
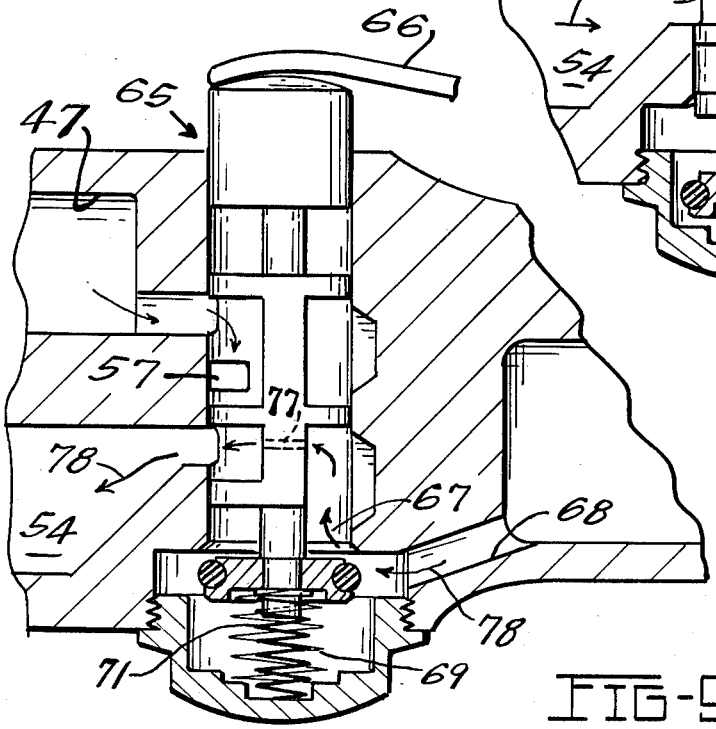
FIG. 9 is another view similar to FIG. 7, with the valve shown in its air-reversing position.

FIGS. 7, 8 and 9 show a modified form of air reversing valve and throttle valve arrangement. The operation of the tool including the valving shown in FIGS. 7, 8 and 9 is identical with the operation described above in connection with the first embodiment. Also, the structure shown in FIGS. 1, 2 and 6 is the same.

In this form of the invention, a spool valve 65 is reciprocable between an uppermost, off position shown in FIG. 7 and a fully depressed position shown in FIG. 8, by a pivoted throttle lever 66. The spool valve 65 is advantageous in that includes a throttle valve 67 at its lower end, thereby eliminating the need for separate throttle and spool valves and saving on the length and number of moving parts in the tool. The tool includes an air intake duct 47, a secondary exhaust duct 54 and an exhaust outlet 57 identical with those described above bearing the same reference numbers. A line air inlet passage 68 admits pressurized air to the upstream side of the throttle valve 67. In the off position shown in FIG. 7, the throttle valve 67 is closed and no air flows to the pneumatic motor. The spool valve 65 is urged toward this position by a compression spring 69. A second, somewhat heavier compression spring 71 disposed concentrically around the spring 69 does not engage the bottom of the spool valve in this position, but is somewhat spaced therefrom as shown in FIG. 7. The purpose of the spring 71 will be explained below When the tool has been engaged on a fastener, the throttle lever 66 is fully depressed to lower the spool valve 65 to the position shown in FIG. 8. As indicated by arrows 72, air passes through the throttle valve 67 and is directed by the spool valve and channels 73 and 74 in the body of the tool to the duct 47 leading to the air inlet of the pneumatic motor. As indicated by arrows 76, the secondary exhaust from the motor passes through the duct 54 and is directed by the spool valve 65 to the exhaust outlet 57. When the tool has reached stall in the tightening of a fastener, the throttle lever 66 is fully released and the drive socket 13 is slipped off the fastener by axial movement.

To realign the drive socket 13 with the slotted opening 12 in the housing 11, the operator presses the throttle lever 66 to the position shown in FIG. 9. The operator can easily determine this position because this is the point at which the stiffer compression spring 71 below the spool valve is contacted by the spool valve. Thus, increased resistance is felt by the operator and he can hold the throttle lever 66 in this position momentarily to reverse air flow.

As indicated in FIG. 9, the throttle valve 67 is now partially opened and pressurized air passing therethrough is directed by the spool 65 through a restricted orifice 77 to the duct 54 which normally handles secondary exhaust (see arrows 78). The motor is thus driven in reverse as described above, with the secondary exhaust resulting from this operation passing backward through the duct 47 to be directed by the spool valve 65 to the exhaust outlet 57. The operator releases the valve lever 66 when the drive socket 13 has been realigned to the starting position. Thus, the drive socket has been returned in the same manner as described above, but with the utilization of a modified, unitary valving apparatus.

We claim:

1. In a power driven tubing wrench having an air motor, a throttle valve for selectively admitting and shutting off a flow of pressurized air to the air motor, a spool valve for controlling the direction of rotation of the air motor by selectively and alternately linking the inlet and exhaust sides of the air motor with pressurized air and the exterior of the tool, a housing extending forward from the air motor and including a forward end with a circular opening therethrough and a radial slot therein, a generally annular, radially slotted fastener driving socket member rotatably positioned within the forward end of the housing, a driving connection between the motor and the socket member, and means for stopping the reverse rotation of the socket member at a position wherein the radial slots of the forward housing end and of the socket member are in alignment, the improvement, comprising a unitary spool and throttle valve stem axially movable from a first position opening to admit air flow to the inlet side of said motor, to a second position to shut off the inlet side of said motor and admit air flow to the exhaust side of said motor and thence to a third position of no air flow.

2. The apparatus of claim 1, wherein said throttle valve and said spool valve are axially shiftable among first, second, and third positions, said first position corresponding to normal operation of the tool wherein a first passageway means establishes air communication between the supply side of said throttle valve and the air motor inlet side of said spool valve and second passageway means for conducting exhaust air from the motor through said spool valve to the exterior of the tool; said second position corresponding to reverse operation of the tool wherein a third passageway means establishes air communication from the supply side of said throttle valve, through means in said spool valve for restricting the flow of air to the secondary exhaust outlet of of the motor and fourth passageway means for conducting air exiting the air inlet of the motor, through said spool valve to the exterior of the tool; and said third position corresponding to a quiescent state of the tool wherein said throttle valve is closed.

3. The apparatus of claim 2 wherein said throttle valve is open to an operating position in said first position of the spool valve, open to a lesser extent in said second position of the spool valve, and closed in a third position of the spool valve, and said spool valve includes means biasing the spool valve and throttle valve toward said third position.

4. The apparatus of claim 2 wherein said spool valve is directly connected to the throttle valve and axially shiftable therewith, said throttle valve being open to an operating position in said first position of the spool valve, open to a lesser extent in said second position of the spool valve, and closed in a third position of the spool valve, and said spool valve includes means biasing the spool valve and throttle valve toward said third position.

5. The apparatus of claim 2 which further includes means providing a discernable increase in the resistance of said spool valve and said throttle valve to movement toward the first position when said spool valve and said throttle valve reach the second position, whereby an operator can readily find the second position and hold said spool valve and said throttle valve in such position.

6. The apparatus of claim 1 wherein said means for stopping the reverse rotation of the socket member comprises a rotatable member in such driving connection, a catch member operably mounted in the housing to move toward and away from the rotatable member, means biasing the catch member toward the rotatable member at least during reverse rotation of the motor, and means positioned on a portion of the rotatable member which passes adjacent the catch member for engaging with the catch member during reverse rotation of the rotatable member to stop the reverse rotation of the rotational member, the motor and the socket member.

7. The apparatus of claim 1 wherein said means for stopping the reverse rotation of the socket member comprises a rotatable member in such driving connection having a helical slot in one face, said slot inclining gradually to meet the face of the rotatable member at a first end of the slot which is its trailing end in forward rotation of the motor and socket member and said slot including a sharp abutment edge at the end opposite said first end; a plunger pin axially slidable in the housing of the tubing wrench into and away from the helical slot; and means biasing the plunger pin toward the slot during reverse rotation of the motor and socket member, whereby, on reverse rotation of the motor, the socket member rotates through a partial revolution until the plunger pin is engaged against the sharp abutment edge of the helical slot.

* * * * *